US010258077B2

(12) United States Patent
Bell et al.

(10) Patent No.: US 10,258,077 B2
(45) Date of Patent: Apr. 16, 2019

(54) TABACCO EXTRACT, PREPARATION THEREOF

(71) Applicant: BRITISH AMERICAN TOBACCO (INVESTMENTS) LIMITED, London (GB)

(72) Inventors: Sally Bell, London (GB); Sharon Goodall, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 530 days.

(21) Appl. No.: 14/419,227

(22) PCT Filed: Jul. 31, 2013

(86) PCT No.: PCT/GB2013/052048

§ 371 (c)(1),
(2) Date: Feb. 2, 2015

(87) PCT Pub. No.: WO2014/020337

PCT Pub. Date: Feb. 6, 2014

(65) Prior Publication Data

US 2015/0189912 A1 Jul. 9, 2015

(30) Foreign Application Priority Data

Aug. 3, 2012 (GB) ..... 1213870.7

(51) Int. Cl.
*A24B 15/24* (2006.01)
*A24B 15/18* (2006.01)

(52) U.S. Cl.
CPC ..... *A24B 15/24* (2013.01); *A24B 15/183* (2013.01); *A24B 15/243* (2013.01)

(58) Field of Classification Search
None
See application file for complete search history.

(56) References Cited

U.S. PATENT DOCUMENTS

| | | | | |
|---|---|---|---|---|
| 4,270,552 | A * | 6/1981 | Jenkins | A24B 15/12 131/290 |
| 4,301,817 | A * | 11/1981 | Keritsis | A24B 15/24 131/297 |
| 5,095,922 | A | 3/1992 | Johnson et al. | |
| 5,137,034 | A * | 8/1992 | Perfetti | A24B 15/165 131/194 |
| 5,322,076 | A | 6/1994 | Brinkley et al. | |
| 5,325,877 | A | 7/1994 | Young et al. | |
| 5,339,838 | A | 8/1994 | Young et al. | |
| 5,343,879 | A | 9/1994 | Teague | |
| 5,360,022 | A | 11/1994 | Newton et al. | |
| 6,024,097 | A | 2/2000 | Von Wielligh | |
| 2004/0255965 | A1 | 12/2004 | Perfetti | |
| 2007/0137665 | A1* | 6/2007 | Torikai | A24B 15/24 131/297 |
| 2011/0083683 | A1* | 4/2011 | Krauss | A24B 15/245 131/297 |
| 2012/0125354 | A1 | 5/2012 | Byrd et al. | |
| 2012/0141648 | A1 | 6/2012 | Morton et al. | |
| 2012/0152265 | A1* | 6/2012 | Dube | A24B 15/302 131/352 |
| 2012/0192880 | A1 | 8/2012 | Dube et al. | |
| 2013/0048001 | A1* | 2/2013 | Williams | A24B 15/38 131/352 |
| 2013/0074855 | A1* | 3/2013 | Holton, Jr. | A24B 15/30 131/275 |

FOREIGN PATENT DOCUMENTS

| | | | |
|---|---|---|---|
| CN | 200983833 | Y | 12/2007 |
| CN | 101392033 | A | 3/2009 |
| CN | 101422276 | A | 5/2009 |
| CN | 101422277 | A | 5/2009 |
| CN | 101444331 | A | 6/2009 |
| CN | 101485490 | A | 7/2009 |
| CN | 101693745 | A | 4/2010 |
| CN | 101708063 | A | 5/2010 |
| CN | 101744357 | A | 6/2010 |
| CN | 101838586 | A | 9/2010 |
| CN | 101845101 | A | 9/2010 |
| CN | 102018279 | A | 4/2011 |
| CN | 201986676 | U | 9/2011 |
| CN | 102318894 | A | 1/2012 |
| CN | 102406230 | A | 4/2012 |
| EP | 2607880 | A1 | 6/2013 |
| WO | WO 93/12675 | | 7/1993 |
| WO | WO 0237989 | | 5/2002 |
| WO | WO 2006/046517 | A1 | 5/2006 |
| WO | WO 2009/135729 | A1 | 11/2009 |
| WO | 2011146264 | A2 | 11/2011 |
| WO | WO 2012/074985 | | 6/2012 |
| WO | WO 2012103074 | | 8/2012 |

OTHER PUBLICATIONS

Chinese Office Action, Chinese Application No. 201380041262.6, dated Feb. 3, 2016, 10 pages.
Japanese Office Action, Japanese Application No. 2015-524842, dated Jan. 6, 2016, 9 pages.
Brans, G. et al., "Membrane fractionation of milk: state of the art and challenges", Journal of Membrane Science, vol. 243, pp. 263-273, 2004.
International Search Report and Written Opinion, dated Jan. 8, 2014 for PCT/GB2013/052048, filed Jul. 31, 2013.
Written Opinion of The IPEA, dated Oct. 9, 2014 for PCT/GB2013/052048, filed Jul. 31, 2013.
International Preliminary Report on Patentability, dated Nov. 19, 2014 for PCT/GB2013/052048, filed Jul. 31, 2013.
Japanese Office Action, Application No. 21/0579, dated Dec. 15, 2015, 4 pages.
Russian Office Action, Application No. 2015 107 026, dated Jun. 26, 2017, 7 pages (14 pages with translation).
Japanese Office Action, Application No. 2016-253409 , dated Dec. 5, 2017, 3 pages.

* cited by examiner

*Primary Examiner* — Eric Yaary
(74) *Attorney, Agent, or Firm* — Patterson Thuente Pedersen, P.A.

(57) ABSTRACT

A process is provided for the preparation and/or treatment of a tobacco extract. The process comprises the treatment of a tobacco extract by centrifugation and microfiltration so that it is suitable for administration to a human.

6 Claims, 7 Drawing Sheets

TABACCO EXTRACT, PREPARATION THEREOF

CLAIM FOR PRIORITY

This application is the National Stage of International Application No. PCT/GB2013/052048, filed Jul. 31, 2013, which in turn claims priority to and benefit of United Kingdom Patent Application No. GB1213870.7, filed Aug. 3, 2012. The entire contents of the aforementioned applications are herein expressly incorporated by reference.

FIELD

The present invention relates to a process. More specifically, the invention relates to a process for the preparation and/or treatment of a tobacco extract.

BACKGROUND

There are many compounds present in tobacco that contribute to its characteristics, such as its flavour.

To retain the quality and flavour of tobacco in a tobacco extract, it is desirable to retain some or all of those compounds that contribute to the tobacco flavour, such as nicotine and other aromatic compounds. However, many aromatic compounds are volatile, and they can therefore be lost during the process of producing and/or treating a tobacco extract, resulting in a tobacco extract with reduced or low levels of aromatic compounds.

During the preparation of tobacco extract, it can be necessary to include one or more concentration steps to achieve the desired concentration of compounds in the tobacco extract. Such concentration steps can lead to the loss of compounds, such as aromatic compounds, from the tobacco extract. Such concentration steps may alternatively or in addition lead to changes in the composition of the tobacco extract, leading to a change in the sensory aspects of the extract, such as the taste of the extract, which may transfer to the final product.

It can be necessary to treat the tobacco extract prior to use to remove microbes. Such treatments include pasteurisation by heating, the addition of anti-microbial agents, high pressure pasteurisation (pascalisation) and gamma irradiation, which can negatively affect the sensory quality and/or the composition of the tobacco extract.

The present invention seeks to provide a process for the preparation of a tobacco extract which overcomes one or more of these difficulties.

SUMMARY

According to a first aspect of the present invention, a process which comprises centrifugation and microfiltration is provided for the treatment of a tobacco extract so that it is suitable for suitable for administration to a human. The treatment may result in the removal of microbes from the tobacco extract.

According to a second aspect of the present invention, a tobacco extract produced according to the first aspect is provided.

According to a third aspect of the present invention, a formulation is provided, comprising the tobacco extract according to the second aspect.

According to a fourth aspect of the present invention, apparatus is provided to carry out the process according to the first aspect.

BRIEF DESCRIPTION OF THE FIGURES

Embodiments of the invention will now be described, by way of example only, with reference to accompanying drawings, in which.

DETAILED DESCRIPTION

The present invention relates to a process of preparing a tobacco extract. The process of preparing a tobacco extract may comprise the production and/or the treatment of a tobacco extract.

Figure 1:
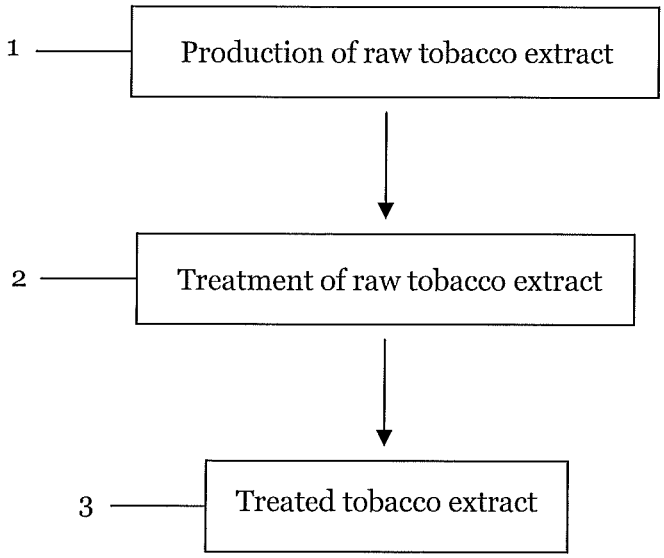
FIG. 1 is a flow diagram illustrating a method of preparing a tobacco extract in accordance with an embodiment of the present invention.

FIG. 1 is a flow diagram outlining a process according to an embodiment of the invention, which comprises the steps of producing a raw tobacco extract 1 and treating the raw tobacco extract 2, to produce a treated tobacco extract 3. In alternative embodiments, the process comprises either one of the steps of producing a raw tobacco extract and treating the raw tobacco extract.

As used herein, the step referred to as the production of raw tobacco extract may also be referred to as the tobacco extraction step. As used herein, the production of raw tobacco extract step comprises producing an extract and separating the solid and liquid, to give a raw tobacco extract. All steps after the production of the raw tobacco extract are referred to as treatment of the raw tobacco extract, to give a treated tobacco extract.

As used herein, the term "raw tobacco extract" refers to the extract resulting from the tobacco extraction step, which has not undergone further treatment. This can be contrasted with the term "treated tobacco extract", which, as used herein, refers to raw tobacco extract that has undergone one or more treatment step(s).

As used herein, the terms "treated tobacco extract" and "raw tobacco extract" comprise material that has been derived or obtained from tobacco. These terms may be used interchangeably with the terms "treated tobacco-derived extract" and "raw tobacco-derived extract".

Figure 2:
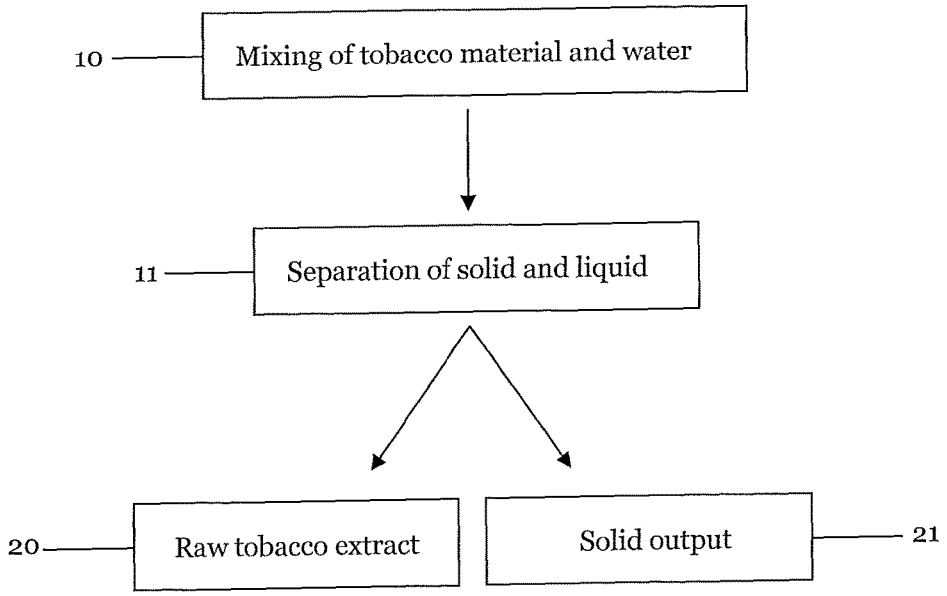
FIG. 2 is a flow diagram illustrating a method of preparing a tobacco extract in accordance with an embodiment of the present invention.

FIG. 2 is a flow diagram illustrating a process for producing a raw tobacco extract according to an embodiment of the invention, which comprises the steps of mixing tobacco material and water 10 and separating the solid and the liquid 11, to give a raw tobacco extract 20 and a solid output 21.

As used herein, the term "tobacco material" includes any part, such as for example the leaves or stems of any member of the genus *Nicotiana* and reconstituted materials thereof.

The tobacco material for use in the present invention is preferably from the species *Nicotiana tabacum*.

The tobacco material may be from one variety of tobacco. Alternatively, the tobacco material may be from more than one variety of tobacco. In other words, the tobacco material may comprise a blend of tobacco varieties. In some embodiments, the tobacco material comprises a tobacco variety or a blend of tobacco varieties with a high nicotine content.

Alternatively or in addition, the nicotine content of the tobacco material may depend on the agronomic conditions under which the tobacco plant is grown. Accordingly, the tobacco material may be selected from tobacco plants that have been grown under particular agronomic conditions.

The tobacco material may comprise tobacco of a certain quality. For example, the tobacco material may comprise tobacco of high, medium and/or low quality. In some preferred embodiments, the tobacco material comprises tobacco of high and/or medium quality.

Any type of tobacco can be used in the present invention. Examples of tobacco which can be used include but are not limited to Virginia, Burley, Oriental and Rustica tobaccos. The tobacco material may be treated according to known practices, such as drying, curing, and so on.

In some preferred embodiments, the tobacco material comprises lamina tobacco material. The tobacco material may comprise up to 50%, up to 60%, up to 70%, up to 80%, up to 90%, or up to 100% lamina tobacco material. In some embodiments, the tobacco material comprises up to 100% lamina tobacco material. In other words, the tobacco material may comprise substantially entirely or entirely lamina tobacco material.

When the tobacco material comprises lamina tobacco material, the lamina may be in the form of cut rag, ground or milled tobacco or whole leaf. In some embodiments in which cut rag is used, the cut rag is manufactured to an average of 60 cuts per inch. In some embodiments the tobacco material is not ground or milled tobacco.

In some embodiments, the tobacco material has a high nicotine content. The nicotine content of the tobacco material may be between 0.2% and 10%. In preferred embodiments, the nicotine content of the tobacco material is between 2% and 7%.

The tobacco may be pasteurised prior to, during and/or after it is mixed with water during the process of preparing an extract. Alternatively, the tobacco material may not be pasteurised prior to, during and/or after it is mixed with water. In some preferred embodiments, the tobacco material is not pasteurised prior to, during and/or after it is mixed with water.

In the processes for producing a tobacco extract, the tobacco material may be mixed with a solvent. An exemplary solvent is an aqueous solvent.

In some embodiments, the tobacco material may be mixed with water. The use of water in the production of raw tobacco extract offers the advantage that substances that are soluble in water can be extracted from the tobacco material. For example, nicotine is soluble in water, and therefore the raw tobacco extract produced by the mixing of water and tobacco material may contain high levels of nicotine and/or other water soluble compounds. Furthermore, producing the raw tobacco extract using water results in a natural product. It is also advantageous to use water as no agents are added during the extraction process that may need to be removed at a later stage.

The water to be mixed with the tobacco material may be municipal water. Alternatively or in addition, the water to be mixed with the tobacco material may be purified water. As used herein, "purified water" relates to water treated to remove contaminants and/or impurities. The use of purified water may minimise the addition of contaminants or other undesirable components during the extraction process, which may subsequently need to be removed. In preferred embodiments, the purified water is deionised water. An advantage of using deionised water over other forms of purified water is the absence of ions that may interfere with later treatment, such as filtration, of the resulting extract.

The tobacco material and water may be mixed by adding the tobacco material to the water. Alternatively, the water may be added to the tobacco material.

The amount of tobacco material used for the production of raw tobacco extract may be any amount and may, for example, be an amount suitable for use on a lab, pilot plant or commercial scale. The amount of tobacco material used for the production of raw tobacco extract may be determined by the amount of raw tobacco extract required and/or the desired concentration of compounds from tobacco in the raw tobacco extract. The amount of tobacco material used for the production of raw tobacco extract may be up to 2 kg, up to 3 kg, up to 4 kg, up to 5 kg, up to 6 kg, up to 7 kg, up to 8 kg, up to 9 kg, up to 10 kg, up to 11 kg, up to 12 kg, up to 13 kg, up to 14 kg, up to 15 kg, up to 16 kg, up to 17 kg, up to 18 kg, up to 19 kg, up to 20 kg, up to 30 kg, up to 40 kg, up to 50 kg, up to 60 kg, up to 70 kg, up to 80 kg, up to 90 kg, up to 100 kg, up to 250 kg, up to 500 kg, up to 750 kg, or up to woo kg. In a preferred embodiment, the amount of tobacco material added for the production of raw tobacco extract is 8 kg.

The amount of water used for the production of raw tobacco extract may be any amount and may, for example, be an amount suitable for use on a lab, pilot plant or commercial scale. The amount of water used for the production of raw tobacco extract may be determined by the amount of raw tobacco extract required and/or the desired concentration of compounds from tobacco in the raw tobacco extract. The amount of water used for the production of raw tobacco extract may be up to 8 liters, up to 9 liters, up to 10 liters, up to 11 liters, up to 12 liters, up to 13 liters, up to 14 liters, up to 15 liters, up to 16 liters, up to 17 liters, up to 18 liters, up to 19 liters, up to 20 liters, up to 30 liters, up to 40 liters, up to 50 liters, up to 60 liters, up to 70 liters, up to 80 liters, up to 90 liters, up to 100 liters, up to 110 liters, up to 120 liters, up to 130 liters, up to 140 liters, up to 150 liters, up to 400 liters, up to 750 liters, up to 1200 liters, or up to 1500 liters. In a preferred embodiment, the amount of water added for the production of raw tobacco extract is 12 liters.

The ratio of the amount of tobacco material to the amount of water used for the production of raw tobacco extract may be selected so that the resulting raw tobacco extract has particular characteristics or properties. For example, a raw tobacco extract produced using a particular ratio of tobacco material to water may contain a certain amount of substances or compounds extracted from the tobacco material.

Therefore, by using a particular ratio of tobacco material to water, it is possible to obtain an extract containing a desirable concentration of one or more substance(s) of interest. For example, using a certain ratio of tobacco material to water may result in a raw tobacco extract with a particular concentration of nicotine.

The ratio of tobacco material to water may be selected to give a raw tobacco extract containing nicotine at a desired concentration, so that the extract is suitable for use without the need for additional steps to concentrate the extract. Steps to concentrate tobacco extract may comprise evaporating some or all of the liquid from the extract. Evaporation may be assisted by heating the extract. Steps to concentrate the extract may lead to changes in the composition of the tobacco extract, leading to a change in the sensory aspects of the extract, such as taste, which would affect the quality of the final product. It is therefore desirable to avoid additional concentration steps, to make the tobacco extraction process economical and/or to produce a final product of the desired quality. For example, steps to concentrate the extract may result in the loss of some or all of the volatile components in the raw tobacco extract. Accordingly, optimising the ratio of tobacco material to water to give a raw tobacco extract with a particular concentration of one or more substances, such as nicotine, may prevent or minimise the loss of volatile components from the raw tobacco extract. Alternatively or in addition, optimising the ratio of tobacco material to water to give a raw tobacco extract with a particular concentration of one or more substances may maintain the chemical and/or physical characteristics of the extract.

Alternatively or in addition, circumventing the need to concentrate the raw tobacco extract may make the production of raw tobacco extract and/or tobacco extract more efficient and/or economical.

The ratio of the amount of tobacco material to the amount of water at the start of the process may be between about 1:1 w/w and 1:9 w/w. Lower ratios of tobacco material to water may result in higher concentrations of nicotine but lower volumes of extract than higher ratios of tobacco material to water. The ratio may be selected according to the desired nicotine concentration and the desired amount of extract. In some embodiments, the ratio of the amount of tobacco material to the amount of water at the start of the process is about 1:1.5 w/w.

When selecting the ratio of tobacco to water, the water content of the tobacco may be considered, and the ratio of the amount of tobacco material to the amount of water may be adjusted accordingly. For example, a smaller amount of water may be needed for tobacco material with a relatively high water content than for tobacco material with a relatively low water content.

According to an embodiment of the invention, the process for the production of tobacco extract gives a raw tobacco extract which comprises between about 0.1 mg/ml and about 60 mg/ml nicotine, optionally between about 3 mg/ml and about 40 mg/ml nicotine. The raw tobacco extract may comprise a nicotine concentration of up to 1 mg/ml, up to 2 mg/ml, up to 3 mg/ml, up to 4 mg/ml, up to 5 mg/ml, up to 6 mg/ml, up to 7 mg/ml, up to 8 mg/ml, up to 9 mg/ml, up to 10 mg/ml, up to 11 mg/ml, up to 12 mg/ml, up to 13 mg/ml, up to 14 mg/ml, up to 15 mg/ml, up to 16 mg/ml, up to 17 mg/ml, up to 18 mg/ml, up to 19 mg/ml, up to 20 mg/ml, up to 21 mg/ml, up to 22 mg/ml, up to 23 mg/ml, up to 24 mg/ml, up to 25 mg/ml, up to 26 mg/ml, up to 27 mg/ml, up to 28 mg/ml, up to 29 mg/ml, up to 30 mg/ml, up to 40 mg/ml, up to 50 mg/ml, or up to 60 mg/ml. In some embodiments, the raw tobacco extract comprises between about 15 mg/ml and about 25 mg/ml nicotine. In some preferred embodiments, the raw tobacco extract comprises between about 18 mg/ml and about 21 mg/ml nicotine.

In some embodiments, the production of a tobacco extract does not include a step for increasing the concentration of the extract by removing liquid, such as the solvent, for example water, from the extract.

The raw tobacco extract may contain nicotine at a concentration that is suitable for use, for example, for combustion. Alternatively, the raw tobacco extract may contain nicotine at a concentration that is higher than required for use. In this case, the raw tobacco extract may be diluted, with water for example, to achieve the desired concentration of nicotine. Therefore, producing a raw tobacco extract with a nicotine concentration that is higher than the desired concentration can offer considerable flexibility, as this one raw tobacco extract may be used to produce extracts containing nicotine at a range of concentrations.

The tobacco material and water may be combined in a mixer. Any type of mixer may be used. A suitable mixer may be a ploughshare mixer. The mixer may be a drum mixer. In some embodiments, the mixer is a horizontal drum mixer. The mixer may have a sufficiently large volume to accommodate the tobacco material and the water. In some embodiments, the mixer has a volume of about 130 liters. In some embodiments, the mixer is a Lodige® Mixer or a Winkworth RT200 mixer.

The tobacco material and water may be mixed by stirring at between about 10 and 100 revolutions per minute (rpm). In some embodiments, the tobacco material and water are stirred at 50 rpm.

The tobacco material and water may be mixed for between about 10 minutes and 5 hours. The tobacco material and water may be mixed for up to 1 hour, up to 2 hours, up to 3 hours, up to 4 hours, or up to 5 hours. In preferred embodiments, the tobacco material and water are mixed for 1 hour.

During and/or after the mixing of the tobacco material and water, the solid and liquid components of the mixture may be separated. In some embodiments, the solid and liquid components are separated after the mixing of the tobacco material and water.

The solid and liquid components of the mixture may be separated by any suitable apparatus. In some embodiments, the solid and liquid components are separated using a press, such as a hydropress, which is also known as a cider press. A suitable hydropress may be obtained from Vigo®. Alternatively or in addition, the solid and liquid components of the mixture may be separated with an alternative apparatus. Suitable apparatus may include a vegetable spinner, a basket centrifuge and/or a belt press. A suitable vegetable spinner may be an Eillert® MSD-500HD Heavy Duty Centrifuge.

All of the tobacco and water mixture may be treated at once to separate the solid and liquid components of the mixture. Alternatively, smaller volumes of the tobacco and water mixture may be treated at one time to separate the solid and liquid components of the mixture. Whether the mixture is treated to separate the solid and liquid components in one batch or in a number of smaller batches may be dependent on the volume of the tobacco and water mixture and the volume accepted by the apparatus used to separate the solid and liquid components of the mixture.

There may be a single mixing step and a single separation step. Alternatively, there may be multiple mixing and separation steps. In preferred embodiments, there is a single mixing step and a single separation step to produce the raw tobacco extract.

The process for producing a raw tobacco extract may be carried out at a defined temperature. The process for producing a raw tobacco extract may be carried out at a temperature selected to minimise the loss of aromatic components and/or volatile aromatic compounds. In particular, the process may be carried out at a temperature which minimises the loss of nicotine from the extract.

Accordingly, the process for producing a raw tobacco extract, which comprises the steps of mixing tobacco material and water, and separating the solid and the liquid, may be carried out at up to 4° C., up to 5° C., up to 6° C., up to 7° C., up to 8° C., up to 9° C., up to 10° C., up to 11° C., up to 12° C., up to 13° C., up to 14° C., up to 15° C., up to 16° C., up to 17° C., up to 18° C., up to 19° C., up to 20° C., up to 21° C., up to 22° C., up to 23° C., up to 24° C., up to 25° C., up to 26° C., up to 27° C., up to 28° C., up to 29° C., up to 30° C., up to 31° C., up to 32° C., up to 33° C., up to 34° C., up to 35° C., up to 36° C., up to 37° C., up to 38° C., up to 39° C., up to 40° C., up to 41° C., up to 42° C., up to 43° C., up to 44° C., or up to 45° C. In some embodiments, the process for producing a raw tobacco extract is carried out at 25° C.

Alternatively or in addition, the process for producing a raw tobacco extract may be carried out at ambient temperature. As used herein, the term "ambient temperature" refers to the temperature of the surroundings. As used herein, the term "ambient temperature" may be used interchangeably with the term "room temperature". Ambient temperature may comprise a temperature of between about 18° C. and 30° C.

In some embodiments, the process for producing a raw tobacco extract does not involve heating the tobacco material or extracting solvent to a temperature above ambient or room temperature before or during the extraction steps.

Alternatively or in addition, the process for producing a raw tobacco extract may be carried out at a temperature lower than ambient temperature. As used herein, the term "lower than ambient temperature" refers to a temperature lower than the temperature of the surroundings. Temperatures lower than ambient temperature may be up to 18° C. Temperatures lower than ambient temperature may be between about 0° C. and 18° C., most suitably between about 10° C. and 18° C.

Producing a raw tobacco extract at a low temperature, such as at ambient temperature or at a temperature lower than ambient temperature, offers the additional advantage that microbial growth may be prevented or limited.

Alternatively or in addition, producing a raw tobacco extract at a low temperature may allow sedimentation or agglomeration, which improves any subsequent filtration step(s) in a process known as winterisation or dehazing.

The composition of tobacco extracts can be complex, and therefore small changes in temperature during extract production may affect the quality and/or composition of the extract. In particular, volatile compounds, such as aromatic compounds, may vaporise from the extract. Due to their instability, even a small increase in temperature may increase the loss of volatile compounds from the extract. For example, a raw tobacco extract produced by a process carried out at a higher temperature may contain fewer volatile compounds, such as aromatic compounds, than a raw tobacco extract produced by a process carried out at a lower temperature, or may contain altered compounds or have a changed composition.

The process for the production of raw tobacco extract may be carried out at a defined pH. The pH may be adjusted prior to, during and/or after the process for the production of raw tobacco extract. Alternatively, the pH may not be adjusted prior to, during and/or after the process for the production of raw tobacco extract. In some preferred embodiments, the pH is not adjusted prior to, during or after the production of raw tobacco extract. If this is the case, the pH of the raw tobacco extract may be determined by the pH of the tobacco material and/or water. Accordingly, the pH of the raw tobacco extract may be about 5.5.

The separation of the solid and liquid produces a raw tobacco extract, which is a liquid, and a solid output.

In an embodiment in which 8 kg of tobacco material is mixed with 12 liters of water, and the solid and liquid components of the mixture are separated using a press, between about 6.0 to 6.5 liters of raw tobacco extract may be produced. The amount of raw tobacco extract produced may be adjusted by altering the amounts of tobacco material and/or water mixed together, and/or by varying the parameters for the separation of the solid and liquid components of the resulting extract.

The solid output may be discarded. Alternatively, the solid output may be suitable for use as a byproduct. The solid output may be suitable for use in reconstituted tobacco or may be suitable for compost, which may be used, for example, for energy production.

Optionally, the raw tobacco extract may be frozen at this point. This may be particularly advantageous if it is not possible to use and/or treat the raw tobacco extract on the same working day as when the raw tobacco extract is produced. The raw tobacco extract may be frozen by placing it in a freezer, which may be at a temperature of about −15° C. to −22° C. If the raw tobacco extract is frozen, it may be defrosted prior to use and/or treatment. The raw tobacco extract may be defrosted in a refrigerator, which may be at a temperature of about 4° C. to about 8° C.

The raw tobacco extract may be suitable for use, for combustion for example, without treatment. Alternatively, the raw tobacco extract may undergo treatment before use. For example, the raw tobacco extract may undergo treatment to remove unwanted components from the raw tobacco extract.

In some embodiments, the raw tobacco extract undergoes treatment to remove microbes from the raw tobacco extract. The removal of microbes may be desirable for the raw tobacco material to be safely used and/or stored.

As used herein, the term "microbes" refers to microorganisms, such as bacteria, fungi and/or protists.

As used herein, the term "removal of microbes" refers to the removal of microbes to attain a microbial level that is acceptable for administration of the treated tobacco extract to a human. For example, when the treated tobacco product is intended for use as a mouth spray, the level of microbes may be reduced to a level that is acceptable for a product that is applied to the oral cavity. Likewise, when the treated tobacco product is intended for application to the nasal cavity, respiratory tract, gastrointestinal tract and/or the skin, the level of microbes may be reduced to a level that is acceptable for this application.

As illustrated in Example 6 below, the removal of microbes may result in an extract with a total viable count of approximately 4 E+02 colony forming units (cfu)/g, an Enterobacteriaceae content of less than 1 cfu/g, a yeast content of less than 1 cfu/g and/or a mould content of approximately 2 cfu/g at 25° C. on the day of producing the treated tobacco extract.

According to an embodiment, the raw tobacco extract undergoes membrane filtration to remove microbes from the raw tobacco extract, so that the resulting extract is suitable for administration to a human, such as by ingestion, inhalation or absorption. The administration may involve, for example, aerosolisation or vaporisation.

Administration may be by application to the oral cavity, nasal cavity, respiratory tract, gastrointestinal tract and/or the skin. In some embodiments, the extract is suitable for administration without combustion.

The raw tobacco extract may undergo microfiltration, ultrafiltration and/or nanofiltration to remove microbes from the raw tobacco extract.

As used herein, the term "microfiltration" refers to filtration using one or more membrane(s) with a pore size of between about 0.1 μm and 10 μm and/or a molecular weight cut-off (MWCO) of greater than about 100,000 daltons.

The term "ultrafiltration" refers to filtration using one or more membrane(s) with a pore size of between about 0.001 μm and about 0.1 μm and/or a MWCO of between about 10,000 and 100,000 daltons.

The term "nanofiltration" refers to filtration using one or more membrane(s) with a pore size of between about 0.0001 μm and 0.001 μm and/or a MWCO of between about 100 and 10,000 daltons.

As used herein, the term "pore size" refers to the nominal pore size.

By treating the raw tobacco extract by membrane filtration it is possible to remove microbes without any treatment that may affect the composition of the extract. For example, by treating the raw tobacco extract by membrane filtration it is possible to remove microbes without heating the extract and/or without the addition of additives to the raw tobacco extract. This may be advantageous when it is preferable to avoid or limit the addition of additives to the raw tobacco extract.

Another advantage of using membrane filtration is that the raw tobacco extract can be treated at or around, or below, ambient temperature. As discussed above, this may confer the significant advantage that the loss of volatile compounds, including nicotine, from the raw tobacco extract is minimised or prevented. Accordingly, the membrane filtration step to remove microbes from the raw tobacco material may be carried out at up to 4° C., up to 5° C., up to 6° C., up to 7° C., up to 8° C., up to 9° C., up to 10° C., up to 11° C., up to 12° C., up to 13° C., up to 14° C., up to 15° C., up to 16° C., up to 17° C., up to 18° C., up to 19° C., up to 20° C., up to 21° C., up to 22° C., up to 23° C., up to 24° C., up to 25° C., up to 26° C., up to 27° C., up to 28° C., up to 29° C., up to 30° C., up to 31° C., up to 32° C., up to 33° C., up to 34° C., up to 35° C., up to 36° C., up to 37° C., up to 38° C., up to 39° C., up to 40° C., up to 41° C., up to 42° C., up to 43° C., up to 44° C., or up to 45° C. In some embodiments, the membrane filtration step to remove microbes from the raw tobacco material is carried out at 25° C. Alternatively or in addition, the membrane filtration step may be carried out at ambient temperature or at a temperature lower than ambient temperature.

In some embodiments, the process for treating a raw tobacco extract does not involve heating the tobacco extract to a temperature above ambient or room temperature before or during the treatment steps.

Treating the raw tobacco extract by membrane filtration at a low temperature, such as at ambient temperature or at a temperature lower than ambient temperature, may assist winterisation or dehazing.

The pH of the raw tobacco extract may be adjusted prior to and/or during the membrane filtration step. Alternatively, the pH of the raw tobacco extract may not be adjusted prior to and/or during the membrane filtration step.

In a preferred embodiment, microfiltration is used to remove microbes from the raw tobacco extract. The use of microfiltration to remove microbes from the raw tobacco extract may be quicker and/or less costly than other forms of membrane filtration, such as ultrafiltration and nanofiltration.

Microfiltration of the raw tobacco extract may comprise filtering the raw tobacco extract with one or more membrane(s) with a pore size of between about 0.1 μm and 10 μm.

In an embodiment, microfiltration of the raw tobacco extract comprises filtering the raw tobacco extract with one or more membrane(s) with a pore size of about 0.2 μm. Using one or more membrane(s) with this pore size enables the raw tobacco extract to be filtered to remove microbes to result in acceptable or lower than acceptable levels of microbes in the solution, whilst at the same time allowing the raw tobacco extract to pass through the filter at a desirable rate.

In an alternative embodiment, the microfiltration step comprises filtering the raw tobacco extract with one or more membrane(s) with a pore size of about 0.45 μm. Alternatively, the microfiltration step may comprise filtering the raw tobacco extract with one or more membrane(s) with a pore size of between about 0.2 μm and 0.45 μm.

The microfiltration step may be carried out under reduced or positive pressure. Suitable pressures and flow rates will be known to a person skilled in the art.

The microfiltration filter may be made of any suitable material. Suitable materials will be known to a person skilled in the art. For example, the microfiltration filter may be a ceramic membrane filter, a polycarbonate membrane filter, a cellulosic membrane filter or a polymeric membrane filter. In some embodiments, the microfiltration filter is a cellulose acetate membrane filter. The microfiltration filter may comprise a combination of suitable materials.

The microfiltration filter may be single use. Alternatively, the microfiltration filter may be reused. Suitable single use and reusable filters will be known to those skilled in the art.

The microfiltration filter may be in any configuration. Exemplary configurations include flat, hollow-fibre or spiral-wound membrane filters.

The microfiltration filter may be a standard microporous membrane. Alternatively, the microfiltration filter may be a track-etched membrane.

The raw tobacco material may be treated prior to, during and/or after the microfiltration step.

Figure 3:
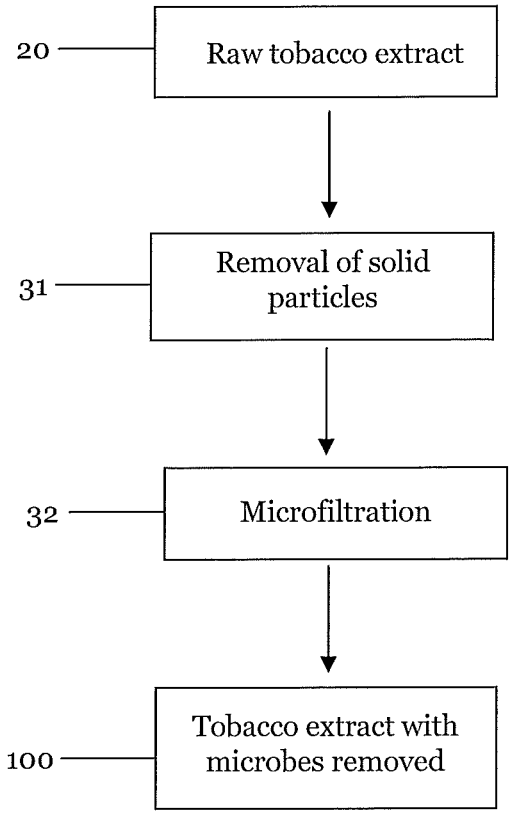
FIG. 3 is a flow diagram illustrating a method of preparing a tobacco extract in accordance with an embodiment of the present invention.

FIG. 3 is a flow diagram illustrating a process for treating raw tobacco extract according to an embodiment of the invention in which the raw tobacco extract 20 is treated prior to the microfiltration step. This embodiment comprises the steps of removing solid particles from the raw tobacco extract 31 and microfiltration 32, to give a tobacco extract with some or all of the microbes removed 100.

The step of removing solid particles from the raw tobacco extract may make the microfiltration step quicker and/or more efficient. For example, removing solid particles from the raw tobacco extract prior to the microfiltration step may enable the treated tobacco extract to pass more quickly and/or more easily though the pores of the membrane filter in the final microfiltration step.

Alternatively or in addition, the step of removing solid particles from the raw tobacco extract may minimise the wear on the microfiltration filter and/or use a smaller filter area, which may reduce the frequency at which it needs to be replaced.

The step of removing solid particles from the raw tobacco extract may comprise filtration. Any method of filtration may be used. The step of removing solid particles from the raw tobacco extract may comprise coarse filtration. In some embodiments, the step of removing solid particles comprises passing the raw tobacco material through a sieve. The sieve may have mesh size of at least 5 μm, at least 10 μm, at least 15 μm, at least 20 μm, at least 25 μm, at least 30 μm, at least 35 μm, at least 40 μm, at least 45 μm, or at least 50 μm. In some embodiments, the sieve has a mesh size of at least 25 μm.

Alternatively or in addition, the step of removing solid particles may comprise passing the raw tobacco material through one or more membrane(s) and/or depth filter(s).

Depth filters typically consist of matrices of organic, inorganic and/or polymeric materials, whereas membranes have pore sizes that only allow particulates that are smaller than that pore size to pass through.

Depth filtration is a process that traps particulates both on the surface of the filter and within the matrix of the filter, and can remove particles of a variety of sizes and retain large quantities of particulates trapped in these matrices. Membrane filtration is a process that traps particulates only on the surface of the filter where the particulates are larger than the pore size of the membrane.

The step of removing solid particles may comprise a cascade or combination filtration. Combination filtration can be a combination of several membrane filters or membrane and depth filters.

The one or more membrane(s) and/or depth filter(s) may be made of any material. The depth filter(s) may be glass fibre depth filter(s), polymeric depth filter(s) and/or cellulosic depth filter(s). In some embodiments, the one or more depth filter(s) are glass fibre filters. Examples of suitable materials and configurations for membrane filters are provided above. In embodiments in which multiple membranes are used, the membrane filters may be set up in parallel or in series.

The one or more depth filter(s) may have charged depth filter materials. Alternatively, non-charged depth filter materials may be used.

In some embodiments, the one or more depth filter(s) may be in the form of pleated cartridges.

The one or more membrane(s) and/or depth filter(s) may have a pore size larger than the pore size of the microfiltration step following the step to remove solid particles from the raw tobacco extract. In some embodiments in which a membrane with a pore size of about 0.2 μm is used for the final microfiltration step, the pore size of the one or more membrane(s) and/or depth filter(s) used in the step to remove solid particles is greater than 0.2 μm. This arrangement may assist the passing of the tobacco extract through the 0.2 μm pores of the membrane(s) of the subsequent microfiltration step.

In some embodiments in which the step to remove solid particles from the raw tobacco extract comprises two or more membrane and/or depth filtration steps, the raw tobacco extract may be passed through progressively finer filters. This may assist in the passing of the raw tobacco extract through the subsequent membrane(s) and/or depth filter(s). In some embodiments in which the step to remove solid particles from the raw tobacco extract comprises two membrane or depth filtration steps, the pore sizes of the first and second membranes may be 1.2 μm and 0.65 μm, respectively, and/or the first and second depth filters may retain particles with a diameter of greater than 10 μm and 0.5-0.75 μm, respectively. In some embodiments in which the step to remove solid particles from the raw tobacco extract comprises multiple filtration steps, the pore sizes of the membrane may be 10 μm, 5 μm, 1.2 μm or 0.45 μm, or combination thereof.

Alternatively or in addition, the step of removing solid particles from the raw tobacco extract may comprise one or more centrifugation step(s).

The centrifugation step(s) may comprise centrifuging the extract at up to 16,000 G, and in some embodiments the centrifugation step(s) comprise centrifuging the extract at 15,900 G. For each centrifugation step, the extract may be centrifuged for up to 5 minutes, up to 10 minutes, up to 15 minutes, up to 20 minutes, up to 25 minutes or up to 30 minutes. In some embodiments, the extract is centrifuged for 10 minutes.

Any centrifuge capable of centrifuging at the desired G force may be used. An example of a suitable centrifuge is a Beckman® Avanti® J-20XP centrifuge.

The centrifuge may accommodate a sufficiently large volume to accommodate all of the raw tobacco extract. Alternatively, the centrifuge may not accommodate a sufficiently large volume to accommodate all of the raw tobacco extract. In this case, the raw tobacco extract may be centrifuged in sub-batches. For example, the raw tobacco extract may be centrifuged in batches of 500 ml. Alternatively or in addition, a continuous centrifuge may be used.

The centrifugation step(s) may be carried out at ambient temperature. Alternatively the centrifugation step(s) may be carried out at a temperature lower than ambient temperature, such as at 4° C.

After centrifugation, the extract may be decanted immediately into a vessel, to separate the liquid tobacco extract from the pellet or precipitate.

The raw tobacco extract may be treated prior to and/or during the step of removing solid particles from the raw tobacco extract. The treatment of the raw tobacco extract may comprise the addition of one or more reagent(s).

One or more flocculation aid(s) may be added prior to and/or during the step of removing solid particles from the raw tobacco extract. The addition of one or more flocculation aid(s) may lead to the coagulation, flocculation and/or precipitation of solid particles in the raw tobacco extract, which may make the step of removing solid particles from the raw tobacco extract more effective and/or more efficient. Any known flocculation aid may be added. In some embodiments, bentonite is added as a flocculation aid. Alternative suitable flocculation aids include silica with or without gelatine and potassium caseinate. Bentonite may be used as a flocculation aid on its own or with gelatine or potassium caseinate. Bentonite may be used in a ratio of 1:10 to 6:1000 w/w bentonite to extract. In a preferred embodiment the ratio of bentonite to extract is no more than 5:100 w/w.

The removal of solid particles from the raw tobacco extract may be carried out at a defined temperature. The step to remove solid particles from the raw tobacco extract may be carried out at up to 4° C., up to 5° C., up to 6° C., up to 7° C., up to 8° C., up to 9° C., up to 10° C., up to 11° C., up to 12° C., up to 13° C., up to 14° C., up to 15° C., up to 16° C., up to 17° C., up to 18° C., up to 19° C., up to 20° C., up to 21° C., up to 22° C., up to 23° C., up to 24° C., up to 25° C., up to 26° C., up to 27° C., up to 28° C., up to 29° C., up to 30° C., up to 31° C., up to 32° C., up to 33° C., up to 34° C., up to 35° C., up to 36° C., up to 37° C., up to 38° C., up to 39° C., up to 40° C., up to 41° C., up to 42° C., up to 43° C., up to 44° C., or up to 45° C. In some embodiments, the removal of solid particles from the raw tobacco extract is carried out at 25° C. In some embodiments, this is done at a temperature of no higher than 25° C., such as a temperature within the range of 10 to 25° C. Alternatively or in addition, the removal of solid particles from the raw tobacco extract may be carried out at ambient temperature and/or at a temperature lower than ambient temperature.

The pH of the raw tobacco extract may be adjusted prior to and/or during the removal of solid particles from the raw tobacco extract. Alternatively, the pH of the raw tobacco extract is not adjusted prior to and/or during the step to remove solid particles from the raw tobacco extract.

In embodiments in which the step for removing solid particles from the raw tobacco extract comprises one or more centrifugation step(s) and one or more membrane filtration and/or depth filtration step(s), the centrifugation step(s) and membrane filtration and/or depth filtration step(s) may be performed in a particular combination to optimise the removal of the solid particles.

Figure 4:
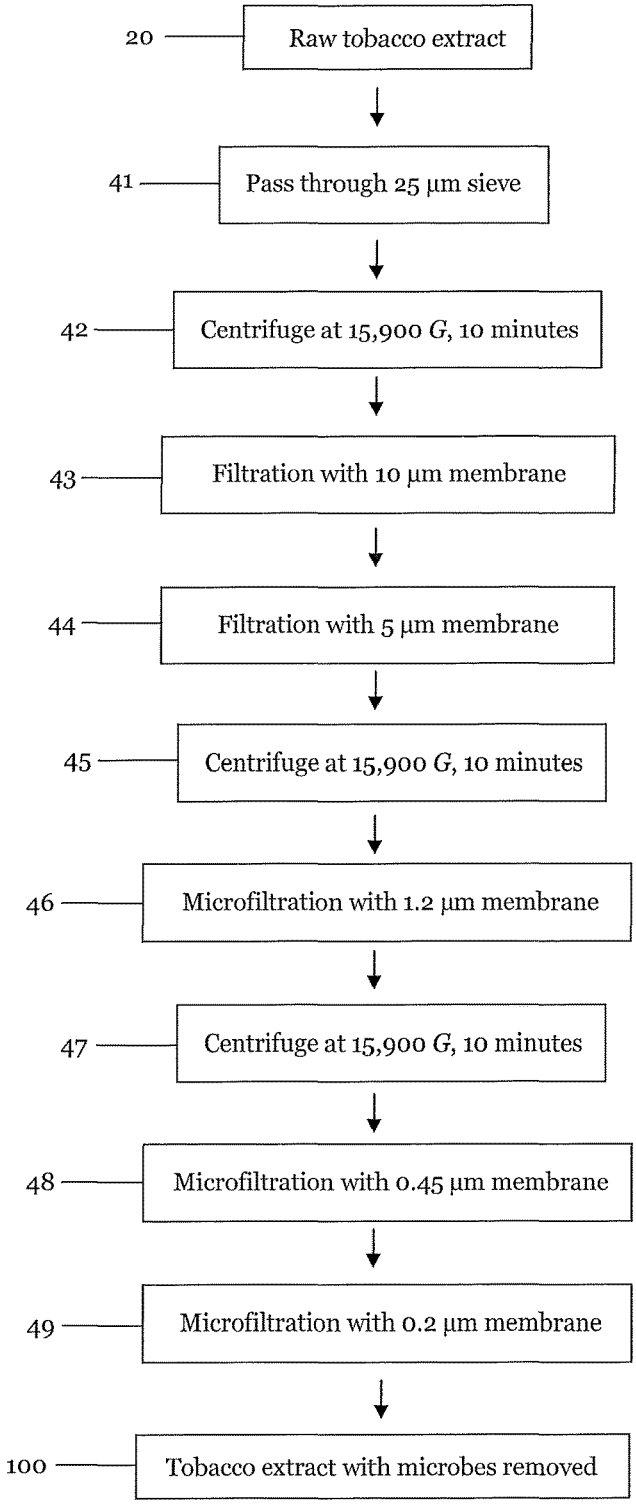
FIG. 4 is a flow diagram illustrating a method of preparing a tobacco extract in accordance with an embodiment of the present invention.

FIG. 4 is a flow diagram illustrating a process for treating raw tobacco extract according to an embodiment. The raw tobacco extract 20 is passed through a sieve with a mesh size of 25 μm 41. The filtrate is centrifuged at 15,900 G for 10 minutes 42, and the liquid phase is passed through a membrane with a pore size of 10 μm 43. The filtrate is passed through a membrane with a pore size of 5 μm 44 and this filtrate is then centrifuged at 15,900 G for 10 minutes 45. The liquid phase from the centrifugation step is passed through a membrane with a pore size of 1.2 μm 46 and the filtrate is then centrifuged at 15,900 G for 10 minutes 47. The liquid phase from the centrifugation step undergoes microfiltration, using a membrane with a pore size of 0.45 μm 48. The filtrate from this microfiltration step undergoes a further microfiltration step, using a membrane with a pore size of 0.2 μm 49. The resulting filtrate is a tobacco extract with microbes removed 100.

Figure 5:
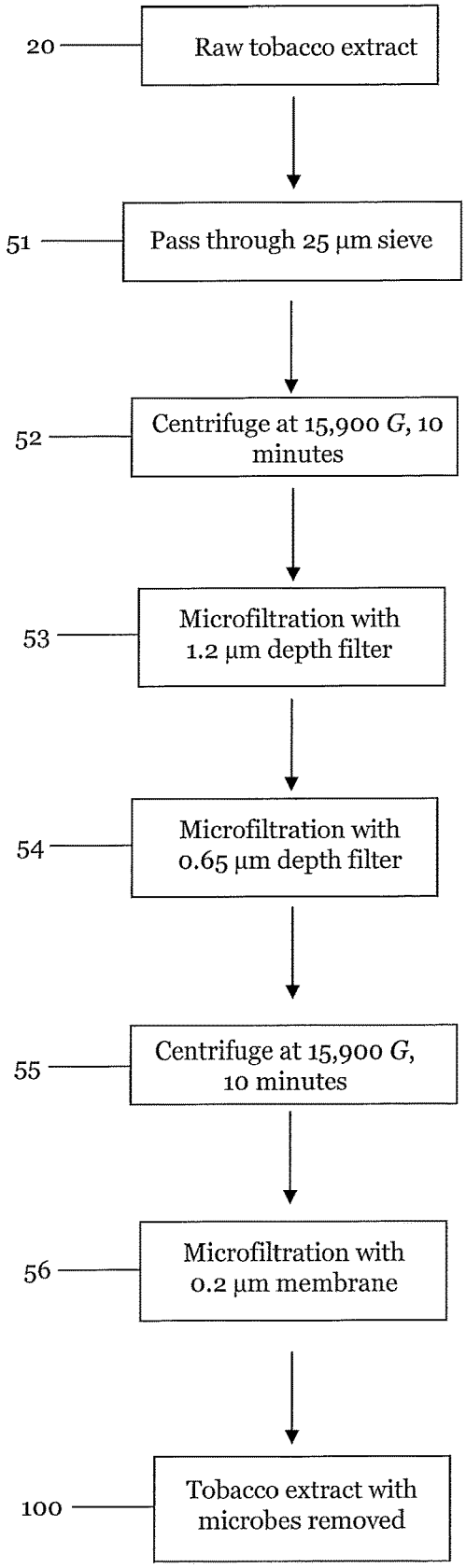
FIG. 5 is a flow diagram illustrating a method of preparing a tobacco extract in accordance with an embodiment of the present invention.

FIG. 5 is a flow diagram illustrating a process for treating raw tobacco extract according to an alternative embodiment. The raw tobacco extract 20 is passed through a sieve with a mesh size of 25 μm 51. The filtrate is centrifuged at 15,900 G for 10 minutes 52, and the liquid phase is passed through a depth filter with a pore size of 1.2 μm 53. The filtrate from this step is passed through a depth filter with a pore size of 0.65 μm 54, and the resulting filtrate is centrifuged at 15,900 G for 10 minutes 55. The liquid phase from the centrifugation step undergoes microfiltration, using a membrane with a pore size of 0.2 μm 56. The filtrate from this microfiltration step is a tobacco extract with microbes removed 100.

Figure 6:
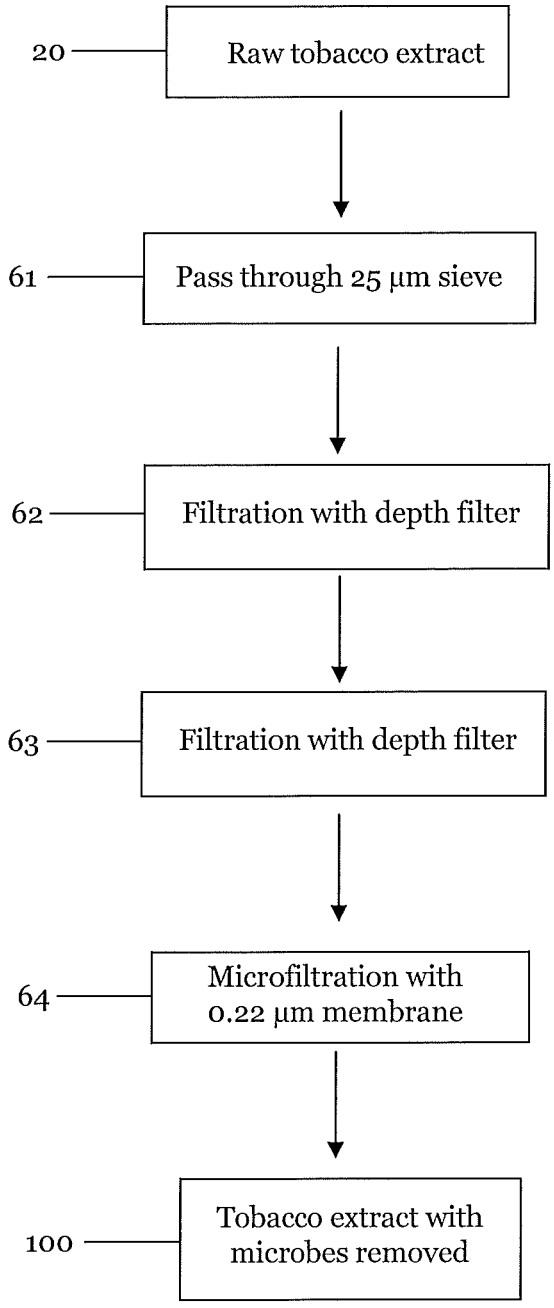
FIG. 6 is a flow diagram illustrating a method of preparing a tobacco extract in accordance with an embodiment of the present invention.

FIG. 6 is a flow diagram illustrating a process for treating raw tobacco extract according to a further alternative embodiment. The raw tobacco extract 20 is passed through a sieve with a mesh size of 25 μm 61. The filtrate is passed through a depth filter 62, and the resulting filtrate is passed through a depth filter that retains smaller particles than the first depth filter 63. The filtrate from this step is passed through a membrane with a pore size of 0.22 μm 64. The filtrate from this microfiltration step is a tobacco extract with microbes removed 100.

In an embodiment, the first depth filter 62 of FIG. 6 retains particles with a diameter greater than about 10 μm and the second depth filter 63 of FIG. 6 retains particles with a diameter greater than about 0.5 μm to 0.75 μm.

The filtrate from the microfiltration step may be deposited into a sterile container. In some embodiments, the filtrate from the final microfiltration step is deposited directly into a sterile container. Any suitable sterile container may be used. Single-use, pre-irradiated bags may be used. An example of a suitable sterile container is a Sartorius® Stedim® Flexboy® bioprocessing bag.

Optionally, the tobacco extract may be frozen following the microfiltration step. The tobacco extract may be frozen by placing it in a freezer, which may be at a temperature of about −15° C. to about −22° C. If the tobacco extract is frozen, it may be defrosted prior to use. The tobacco extract may be defrosted in a refrigerator, which may, for example, be at a temperature of about 4° C. to about 8° C.

Following the production of the raw tobacco extract and/or the treatment of the raw tobacco extract as described above to give a tobacco extract with microbes removed, the raw tobacco extract and/or the tobacco extract with microbes removed may be suitable for use.

The raw tobacco extract and/or the tobacco extract with microbes removed may be applied to a solid material. For example, the raw tobacco extract and/or the tobacco extract with microbes removed may be applied to tobacco material.

Alternatively or in addition, the raw tobacco extract and/or the tobacco extract with microbes removed may be combined with other liquids. For example, the raw tobacco extract and/or the tobacco extract with microbes removed may be combined with other tobacco extracts.

Alternatively or in addition, the phase of the raw tobacco extract and/or the tobacco extract may be changed. The phase of the liquid raw tobacco extract and/or tobacco extract with microbes removed may be changed to a solid. Alternatively, the phase of the liquid raw tobacco extract and/or tobacco extract with microbes removed may be changed to a gas.

In some embodiments, the liquid component of the liquid raw tobacco extract and/or tobacco extract with microbes removed is removed, resulting in an extract in powder form. This extract in powder form may be suitable for administration to a human. In particular, the extract in powder form may be suitable for inhalation and/or application to the oral cavity, nasal cavity and/or respiratory tract, and may be suitable for use in a dry powder device, for example.

Optionally, the tobacco extract with microbes removed is formulated prior to use.

As used herein, the term "formulation" refers to a liquid comprising the tobacco extract with microbes removed that has been diluted to the desired nicotine concentration and/or has had suitable preservatives and/or flavours added so that it is suitable for human consumption. The term "formulated" can be construed accordingly.

The tobacco extract with microbes removed may be formulated for subsequent use. The tobacco extract with microbes removed may be formulated for subsequent use as a mouth spray.

The tobacco extract with microbes removed may be formulated by the addition of one or more additive(s). The tobacco extract with microbes removed may be formulated for subsequent use as a mouth spray by the addition of one or more additive(s). Suitable additives may include: diluents such as water, ethanol and/or propylene glycol; preservatives such as ethanol, propylene glycol, glycerol, sodium benzoate and/or benzalkonium chloride; flavourant; solubilisers and/or surfactants such as Poloxamer 407 and/or Solutol® H515; viscosity adjusters such as propylene glycol and/or glycerol; stabilisers; and thickening agents.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the tobacco extract with microbes removed is formulated for subsequent use as a mouth spray by the addition of menthol.

The one or more additive(s) to be added to the tobacco extract may be water soluble. Alternatively or in addition, the one or more additive(s) to be added to the tobacco extract may not be water soluble.

In embodiments where the tobacco extract with microbes removed is aqueous, the extract may be treated so that one or more additive(s) that are not water soluble can be dissolved. A suitable additive may be an alcohol, which may include but is not limited to ethanol. In some embodiments in which ethanol is added to the tobacco extract, solids may precipitate or flocculate, which may be removed by filtration.

Any suitable amount of alcohol may be added to the aqueous extract. In some embodiments in which ethanol is added to the aqueous extract, the resulting ratio of extract to ethanol may be 2:1 w/w.

Following the addition of alcohol to the aqueous extract, the resulting mixture may be stirred. The mixture may be stirred at a sufficient speed and for a sufficient amount of time for the alcohol and the extract to be well mixed. In some embodiments, the mixture is stirred at 200 rpm for 10 minutes.

The solution comprising alcohol and extract may be allowed to stand for a sufficient period of time for the solution to separate into solid and liquid fractions. In some embodiments, the solution comprising alcohol and extract is allowed to stand for 48 hours at 4° C.

The supernatant may be centrifuged. The supernatant may be centrifuged for up to 5 minutes, up to 10 minutes, up to 15 minutes, up to 20 minutes, up to 25 minutes or up to 30 minutes. In some embodiments, the supernatant is centrifuged for 10 minutes.

The supernatant may be centrifuged at 908 G. Any centrifuge capable of centrifuging at the desired G force may be used. An example of a suitable centrifuge is a Beckman® Avanti® J-20XP centrifuge at 1910 rpm.

The supernatant from the centrifugation step may undergo microfiltration. In some embodiments, the supernatant from the preceding centrifugation step undergoes microfiltration using a membrane with a pore size of about 0.2 μm.

The treatment of tobacco extract so that one or more additive(s) that are not water soluble can be dissolved can be carried out at ambient temperature. Alternatively the treatment may be carried out at 4° C., or any temperature between 4° C. and ambient temperature. In some embodiments, different steps of the treatment of tobacco extract are carried out at different temperatures.

Figure 7:
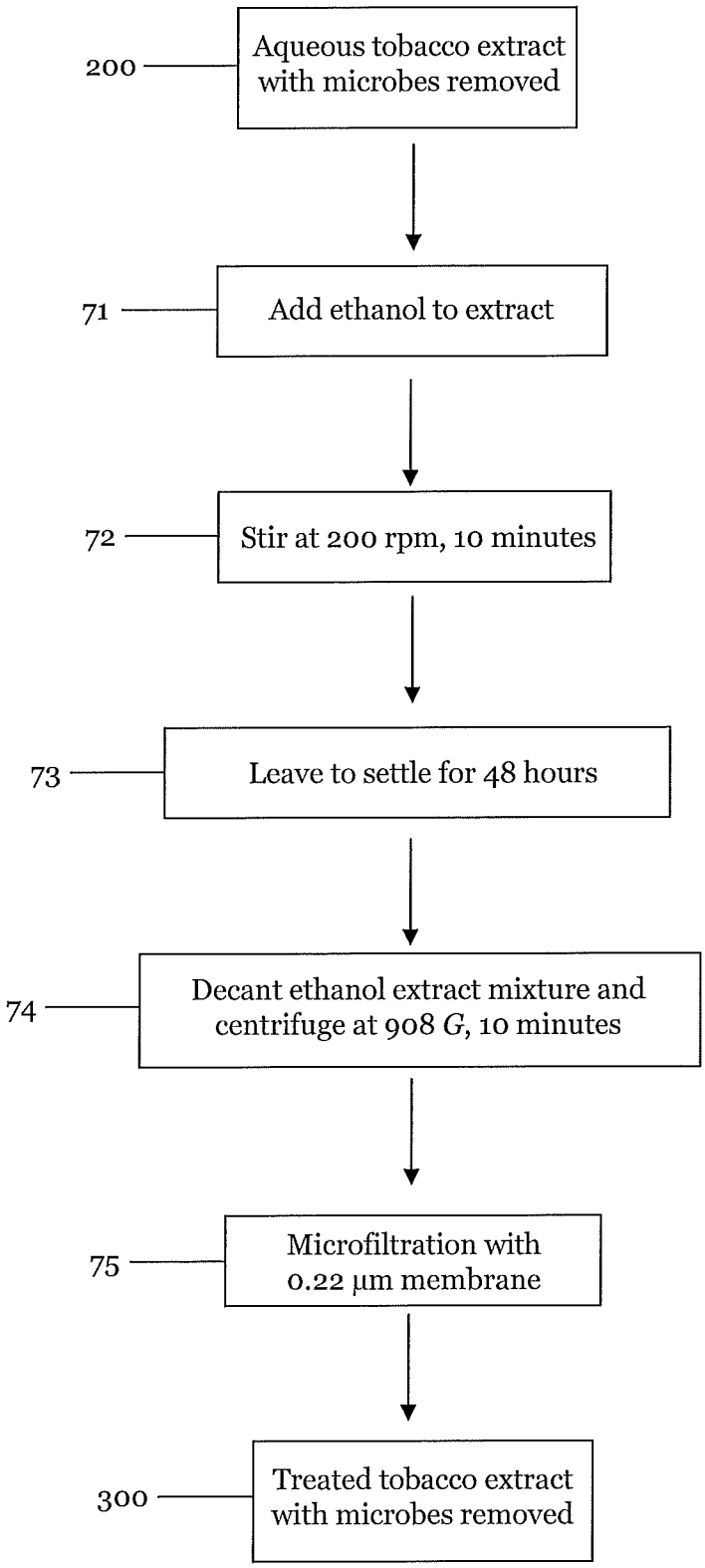
FIG. 7 is a flow diagram illustrating a method of preparing a tobacco extract in accordance with an embodiment of the present invention.

FIG. 7 is a flow diagram illustrating a process for treating aqueous tobacco extract with microbes removed according to an embodiment. Ethanol is added 71 to aqueous tobacco extract with microbes removed 200 and the resulting mixture is stirred for 10 minutes at 200 rpm 72. The extract-ethanol mixture is allowed to stand for 48 hours at 4° C. 73. The liquid fraction of the extract-ethanol mixture is then decanted and the supernatant is centrifuged for 10 minutes at 908 G 74. The resulting supernatant undergoes microfiltration, using a membrane with a pore size of 0.22 μm 75. The filtrate from this microfiltration step is a tobacco extract with microbes removed, treated so that one or more additive(s) that are not water soluble can be dissolved 300.

The mouth spray comprising the tobacco extract with microbes removed that has been suitably formulated may be delivered by any suitable apparatus. In some embodiments, the mouth spray formulation is delivered by a pump spray. Suitable pump sprays to deliver the mouth spray include conventional pump sprays, syringe pump sprays and breath-actuated spray systems. Other suitable apparatus to deliver the mouth spray will be known to those skilled in the art. Between about 50 and 140 μl of mouth spray may be delivered per spray.

EXAMPLES

The present invention is illustrated in greater detail by the following specific Examples. It is to be understood that these Examples are illustrative embodiments and that this invention is not to be limited by any of the Examples.

Production of Extract

Example 1

12 kg of deionised water was added to 8 kg of tobacco material in a clean Lodige® Mixer or a Winkworth RT200 mixer and the mixture was stirred at 50 rpm for 60 minutes. The solid and liquid components of the mixture were separated using a Vigo® hydropress or an Eillert® MSD-500HD Heavy Duty Centrifuge, producing raw tobacco extract and a solid extract. All of the steps of the production of the extract were carried out at 25° C. The raw tobacco extract was stored at −20° C. until required.

Treatment of Extract

Example 2

6 liters of raw tobacco extract produced according to Example 1 was passed through a sieve with a mesh size of 25 μm. The filtrate was centrifuged at 8000 rpm for 10 minutes using a Beckman® Avanti® J-20XP centrifuge at 4° C. The liquid phase was passed through a membrane with a pore size of 10 μm (Millipore® Isopore® membrane, catalogue no. TCTP04700). The filtrate was passed through a membrane with a pore size of 5 μm (Millipore® Isopore® membrane, catalogue no. TMTP04700). The filtrate was centrifuged at 8000 rpm for 10 minutes using a Beckman® Avanti® J-20XP centrifuge at 4° C. The liquid phase was passed through a membrane with a pore size of 1.2 μm (Millipore® Isopore® membrane, catalogue no. RTTP04700), the filtrate was centrifuged at 8000 rpm for 10 minutes using a Beckman® Avanti® J-20XP centrifuge at 4° C. and the liquid phase was passed through a membrane with a pore size of 0.45 μm (Whatman® cellulose acetate 47 mm membrane, catalogue no. 7000 0004). The filtrate from this microfiltration step was then passed through a membrane with a pore size of 0.2 μm (Whatman® cellulose acetate 47 mm membrane, catalogue no. 7001 0004). Unless stated otherwise, the steps of the extract treatment process were carried out at 25° C. The filtrate was stored at −20° C. until required.

Example 3

6 liters of raw tobacco extract produced according to Example 1 was passed through a sieve with a mesh size of 25 μm. The filtrate was centrifuged at 8000 rpm for 10 minutes using a Beckman® Avanti® J-20XP centrifuge at 4° C. The liquid phase was passed through a depth filter with a pore size of 1.2 μm (SartoScale Disposable Sartopure® GF Plus, catalogue no. 5555303PS-FF-M). The filtrate was passed through a depth filter with a pore size of 0.65 μm (SartoScale Disposable Sartopure® GF Plus, catalogue no. 5555305PS-FF-M), and the resulting filtrate was centrifuged at 8000 rpm for 10 minutes using a Beckman® Avanti® J-20XP centrifuge at 4° C. The liquid phase from the centrifugation step was passed through a membrane filter with a pore size of 0.2 μm (SartoScale Disposable Sartobran® P, catalogue no. 5235307HS-FF-M). Unless stated otherwise, the steps of the extract treatment process were carried out at 25° C. The filtrate from this microfiltration step was stored at −20° C. until required.

Example 4

6 liters of raw tobacco extract produced according to Example 1 was passed through a sieve with a mesh size of 25 μm. The filtrate was passed through a depth filter (Millipore® Millistak® D0HC depth filter), and the resulting filtrate was passed through a depth filter (Millipore® Millistak® F0HC or B1HC depth filter) that retained smaller particles than the first depth filter. The filtrate was then passed through a membrane with a pore size of 0.22 μm (Millipore® Durapore® 0.22 μm Optiscale® 25 (3.5 $cm^2$), catalogue no. SVGLA25NB6). All of the steps of the extract treatment process were carried out at 25° C. The filtrate from this microfiltration step was stored at −20° C. until required.

Example 5

271.2 g of ethanol was added to 539.1 g tobacco extract that had been prepared according to the process of Example 2, and the resulting mixture was stirred for 10 minutes at 200 rpm at ambient temperature using a IKA stirrer hotplate (model RCT B). The extract-ethanol mixture was allowed to stand for 48 hours at 4° C. to 8° C. The extract-ethanol mixture was then manually decanted and the supernatant was centrifuged for 10 minutes at 1910 rpm [908 G] at ambient temperature using a Beckman® Avanti® J-20XP centrifuge. The supernatant was then filtered through a membrane with a pore size of 0.22 μm (Millipore® Durapore® membrane, catalogue no. GVWP04700). Unless stated otherwise, all of the steps of the extract treatment process were carried out at 25° C. The filtrate was stored at −20° C. until required.

Analysis of Microbial Content

Example 6

The microbial content of two extracts treated according to the process of Example 2 was analysed.

The two extracts, Extract A and Extract B, were prepared in separate batches and were tested separately, at different points in time.

Samples of each extract were tested following 0, 2, 4 or 7 days of storage at 25° C., 5° C. or −18° C. On each sampling occasion, 1 ml of extract was taken and a 1:10 dilution was performed using Maximum Recovery Diluent (MRD). A serial dilution series, using MRD, was then performed. An undiluted sample was also tested.

Samples were tested for Aerobic Plate Count (APC), and Enterobacteriaceae, yeasts and moulds. The pour plate technique was followed for APC and Enterobacteriaceae testing, and the spread plate technique was used to test for yeasts and moulds.

For the APC, Plate Count Agar (PCA) was used following a method based on the standard BS EN ISO 4833:2003 and the plates were incubated at 30° C.±1° C. for 48 hours.

For the enumeration of Enterobacteriaceae, Violet Red Bile Glucose Agar (VRBGA) was used following a method based on the standard BS ISO 21528-2:2004. Samples were applied to the plates, the plates were allowed to set, overlayered with VRBGA, allowed to set once again, inverted and incubated at 37° C.±1° C. for 24±2 hours, after which all of the resultant colonies were counted.

For the enumeration of yeast and moulds, Dichloran-rose bengal chloramphenicol agar (DRBCA) was used following a method based on BS EN 21527-1:2008 and the plates were incubated at 25° C.±1° C. for 7 days.

The results of the analysis of the microbial content of Extract A are provided in Tables 1 to 3, and the results of the analysis of the microbial content of Extract B are provided in Tables 4 to 6.

TABLE 1

Microbial analysis of Extract A at 5° C.

| Day | Total Viable Count (cfu/g) | Enterobacteriaceae (cfu/g) | Yeasts (cfu/g) | Moulds (cfu/g) |
|---|---|---|---|---|
| 0 | 4.60E+02 | <1 | 2 | 1.00E+01 |
| | 4.50E+02 | <1 | 30 | 3.00E+01 |
| | 4.10E+02 | <1 | 1 | 1.00E+01 |
| Mean | 4.43E+02 | <1 | 11 | 1.67E+01 |
| 2 | 4.40E+02 | <1 | <1 | 2.90E+01 |
| | 2.60E+02 | <1 | 60 | 1.00E+01 |
| | 2.60E+02 | <1 | <1 | 2.30E+02 |
| Mean | 3.20E+02 | <1 | 60 | 8.97E+01 |
| 4 | 2.00E+02 | <1 | <1 | <1 |
| | 5.30E+02 | <1 | <1 | <1 |
| | 4.00E+02 | <1 | <1 | <1 |
| Mean | 3.77E+02 | <1 | <1 | <1 |
| 7 | 2.70E+02 | <1 | <1 | <1 |
| | 2.50E+02 | <1 | 1 | <1 |
| | 2.00E+02 | <1 | 1 | <1 |
| Mean | 2.40E+02 | <1 | 1 | <1 |

TABLE 2

Microbial analysis of Extract A at 25° C.

| Day | Total Viable Count (cfu/g) | Enterobacteriaceae (cfu/g) | Yeasts (cfu/g) | Moulds (cfu/g) |
|---|---|---|---|---|
| 0 | 4.60E+02 | <1 | 2 | 10 |
| | 4.60E+02 | <1 | 30 | 30 |
| | 4.10E+02 | <1 | 1 | 10 |
| Mean | 4.43E+02 | <1 | 11 | 17 |
| 2 | 3.10E+02 | <1 | <1 | 110 |
| | 2.80E+02 | <1 | <1 | 20 |
| | 4.30E+02 | <1 | <1 | 10 |
| Mean | 3.40E+02 | <1 | <1 | 47 |
| 4 | 5.90E+04 | <1 | <1 | <1 |
| | 4.20E+03 | <1 | <1 | <1 |
| | 3.00E+03 | <1 | <1 | <1 |
| Mean | 2.21E+04 | <1 | <1 | <1 |
| 7 | 3.60E+08 | <1 | 2 | <1 |
| | 6.70E+07 | <1 | <1 | <1 |
| | 1.90E+08 | <1 | <1 | <1 |
| Mean | 2.06E+08 | <1 | 2 | <1 |

TABLE 3

Microbial analysis of Extract A at −18° C.

| Day | Total Viable Count (cfu/g) | Enterobacteriaceae (cfu/g) | Yeasts (cfu/g) | Moulds (cfu/g) |
|---|---|---|---|---|
| 0 | 4.60E+02 | <1 | 2 | 10 |
| | 4.60E+02 | <1 | 3.00E+01 | 30 |
| | 4.10E+02 | <1 | 1 | 10 |
| Mean | 4.43E+02 | <1 | 1.10E+01 | 17 |
| 2 | 3.30E+02 | <1 | <1 | 10 |
| | 3.20E+02 | <1 | <1 | 30 |
| | 4.90E+02 | <1 | <1 | 120 |
| Mean | 3.80E+02 | <1 | | 53 |
| 4 | 3.10E+02 | <1 | <1 | 1 |
| | 3.40E+02 | <1 | <1 | <10 |
| | 3.80E+02 | <1 | <1 | 10 |
| Mean | 3.43E+02 | <1 | | 6 |
| 7 | 3.80E+02 | <1 | 2 | 2 |
| | 3.60E+02 | <1 | <1 | <1 |
| | 3.10E+02 | <1 | 3 | <1 |
| Mean | 3.50E+02 | <1 | 3 | 2 |

TABLE 4

Microbial analysis of Extract B at 5° C.

| Day | Total Viable Count (cfu/g) | Enterobacteriaceae (cfu/g) | Yeasts (cfu/g) | Moulds (cfu/g) |
|---|---|---|---|---|
| 0 | <1 | <1 | <1 | 2 |
| | <1 | <1 | <1 | 3 |
| | <1 | <1 | <1 | 1 |
| Mean | <1 | <1 | <1 | 2 |
| 2 | <1 | <1 | <1 | 2.20E+03 |
| | <1 | <1 | 80 | 3.50E+03 |
| | <1 | <1 | <1 | 1.10E+02 |
| Mean | <1 | <1 | 80 | 1.94E+03 |
| 4 | <1 | <1 | 6 | <1 |
| | <1 | <1 | 11 | 2 |
| | <1 | <1 | <1 | 1 |
| Mean | <1 | <1 | <1 | <1 |
| 7 | <1 | <1 | <1 | <1 |
| | 2 | <1 | 31 | 1 |
| | 1 | <1 | <1 | <3 |
| Mean | 1.5 | <1 | 31 | <1 |

TABLE 5

Microbial analysis of Extract B at 25° C.

| Day | Total Viable Count (cfu/g) | Enterobacteriaceae (cfu/g) | Yeasts (cfu/g) | Moulds (cfu/g) |
|---|---|---|---|---|
| 0 | <1 | <1 | <1 | 2 |
| | <1 | <1 | <1 | 3 |
| | <1 | <1 | <1 | 1 |
| Mean | <1 | <1 | <1 | 2 |
| 2 | <1 | <1 | <1 | 4.20E+02 |
| | <1 | <1 | 284 | 4.00E+02 |
| | <1 | <1 | <1 | 6.00E+00 |
| Mean | <1 | <1 | 2.84E+02 | 2.75E+02 |
| 4 | <1 | <1 | <1 | <1 |
| | <1 | <1 | <1 | 3 |
| | <1 | <1 | <1 | 2 |
| Mean | <1 | <1 | <1 | <1 |
| 7 | <1 | <1 | <1 | <1 |
| | <1 | <1 | <1 | <1 |
| | <1 | <1 | <1 | 1 |
| Mean | <1 | <1 | <1 | <1 |

TABLE 6

Microbial analysis of Extract B at −18° C.

| Day | Total Viable Count (cfu/g) | Enterobacteriaceae (cfu/g) | Yeasts (cfu/g) | Moulds (cfu/g) |
|---|---|---|---|---|
| 0 | <1 | <1 | <1 | 2.00E+00 |
| | <1 | <1 | <1 | 3.00E+00 |
| | <1 | <1 | <1 | 1.00E+00 |
| Mean | <1 | <1 | <1 | 2.00E+00 |
| 2 | <1 | <1 | <1 | 2.70E+03 |
| | <1 | <1 | <1 | 1.00E+00 |
| | <1 | <1 | <1 | 3.90E+01 |
| Mean | <1 | <1 | <1 | 9.13E+02 |
| 4 | <1 | <1 | <1 | 2 |
| | <1 | <1 | 55 | 1 |
| | 2 | <1 | <1 | 1 |
| Mean | <2 | <1 | 55 | 1 |
| 7 | <1 | <1 | <1 | 1 |
| | <1 | <1 | <2 | 1 |
| | <1 | <1 | <1 | 1 |
| Mean | <1 | <1 | <1 | 1 |

It is clear from Tables 1 to 6 that Extracts A and B contained very low levels of microorganisms following sample preparation, often below the limit of detection. This illustrates that the process outlined in Example 1 is effective at removing microorganisms from the extract.

The levels of microorganisms generally remained very low throughout storage, and this was the case across the range of storage temperatures tested, from frozen storage (−18° C.), to storage at chilled (5° C.) and ambient (25° C.) temperatures. One exception to this is the increase in the level of Total Viable Count in Extract A over 7 days of storage at 25° C. However, this increase in TVC levels was not seen during storage of Extract B.

Accordingly, it can be concluded that filtration using filters with 0.2 μm pores removes or reduces the levels of microbes in tobacco extracts, often to levels that are below the limit of detection of the methods used, and the resulting extracts are generally stable when stored under frozen, chilled or ambient conditions.

Example 7

Seven different tobacco extracts were prepared by adding sterile distilled water to seven different tobacco materials in a ratio of 1:10 tobacco to water. Each tobacco/water mix was shaken for 60 minutes on an orbital shaker at room temperature. After shaking, the product was drained through a sterile filter stomacher bag to remove large pieces of tobacco. Each liquid extract was divided into three portions. One portion was left unfiltered, one portion was filtered through a filter with a pore size of 0.2 μm, and one portion was filtered through a filter with a pore size of 0.45 μm. As a control, sterile distilled water was treated in the same way. The extraction procedure was carried out twice for each tobacco material to produce duplicate extracts.

The microbial content of the extracts was analysed as described in Example 6 on the day of preparation and after 2, 4 or 7 days of storage at 25° C. The results of the analyses are provided in Tables 7 to 13.

TABLE 7

| Level of Enterobacteriaceae (cfu/g) in unfiltered extracts | | | | |
|---|---|---|---|---|
| Product | Day 0 | Day 2 | Day4 | Day 7 |
| GR10/00199 | | | | |
| 1a | $2.00 \times 10^2$ | $>1.5 \times 10^6$ | $4.60 \times 10^8$ | $1.70 \times 10^8$ |
| 1b | 35 | $>1.5 \times 10^6$ | $8.00 \times 10^8$ | $2.70 \times 10^8$ |
| Mean | $1.18 \times 10^2$ | $>1.5 \times 10^6$ | $6.30 \times 10^8$ | $2.20 \times 10^8$ |
| GR10/0201 | | | | |
| 2a | <1 | <1 | <1 | <1 |
| 2b | <1 | <1 | <1 | <1 |
| Mean | <1 | <1 | <1 | <1 |
| GR10/00203 | | | | |
| 3a | <1 | $>1.5 \times 10^6$ | $1.80 \times 10^7$ | $2.60 \times 10^7$ |
| 3b | 13 | $>1.5 \times 10^6$ | $1.10 \times 10^8$ | $7.00 \times 10^8$ |
| Mean | 13 | $>1.5 \times 10^6$ | $6.40 \times 10^7$ | $1.65 \times 10^7$ |
| GR10/00205 | | | | |
| 4a | <1 | $>1.5 \times 10^6$ | $1.20 \times 10^8$ | $3.80 \times 10^8$ |
| 4b | <1 | $>1.5 \times 10^6$ | $1.90 \times 10^8$ | $3.10 \times 10^7$ |
| Mean | <1 | $>1.5 \times 10^6$ | $1.55 \times 10^8$ | $2.06 \times 10^8$ |
| GR10/00207 | | | | |
| 5a | <1 | $>1.5 \times 10^6$ | <1 | $7.80 \times 10^8$ |
| 5b | <1 | <1 | <1 | <1 |
| Mean | <1 | NA | <1 | $7.80 \times 10^8$ |
| GR10/00209 | | | | |
| 6a | <1 | <1 | <1 | <1 |
| 6b | <1 | <1 | <1 | <1 |
| Mean | <1 | <1 | <1 | <1 |
| GR10/00211 | | | | |
| 7a | <1 | <1 | <1 | <1 |
| 7b | <1 | <1 | <1 | <1 |
| Mean | <1 | <1 | <1 | <1 |

TABLE 8

| Level of Aerobic Plate Count (cfu/g) in unfiltered extracts | | | | |
|---|---|---|---|---|
| Product | Day 0 | Day 2 | Day4 | Day 7 |
| GR10/00199 | | | | |
| 1a | $9.50 \times 10^4$ | $>3 \times 10^6$ | $8.80 \times 10^8$ | $4.80 \times 10^8$ |
| 1b | $4.30 \times 10^4$ | $>3 \times 10^6$ | $1.40 \times 10^9$ | $2.60 \times 10^8$ |
| Mean | $6.90 \times 10^4$ | $>3 \times 10^6$ | $1.14 \times 10^9$ | $3.70 \times 10^8$ |
| GR10/0201 | | | | |
| 2a | $1.80 \times 10^3$ | $2.70 \times 10^3$ | $4.50 \times 10^2$ | $2.80 \times 10^4$ |
| 2b | $3.70 \times 10^3$ | $9.50 \times 10^4$ | $7.10 \times 10^6$ | $>3 \times 10^7$ |
| Mean | $2.75 \times 10^3$ | $4.89 \times 10^4$ | $3.55 \times 10^6$ | $2.80 \times 10^4$ |
| GR10/00203 | | | | |
| 3a | $1.60 \times 10^5$ | $>3 \times 10^6$ | $2.00 \times 10^8$ | $6.80 \times 10^8$ |
| 3b | $3.40 \times 10^5$ | $>3 \times 10^6$ | $5.20 \times 10^8$ | $2.10 \times 10^8$ |
| Mean | $2.50 \times 10^5$ | $>3 \times 10^6$ | $3.60 \times 10^8$ | $4.45 \times 10^8$ |
| GR10/00205 | | | | |
| 4a | $1.00 \times 10^4$ | $>3 \times 10^6$ | $2.80 \times 10^7$ | $9.70 \times 10^8$ |
| 4b | $3.50 \times 10^3$ | $>3 \times 10^6$ | $1.30 \times 10^9$ | $1.00 \times 10^9$ |
| Mean | $6.75 \times 10^3$ | $>3 \times 10^6$ | $6.64 \times 10^8$ | $9.85 \times 10^8$ |
| GR10/00207 | | | | |
| 5a | $7.00 \times 10^2$ | $>3 \times 10^6$ | $1.80 \times 10^8$ | $2.00 \times 10^7$ |
| 5b | $5.00 \times 10^2$ | $2.50 \times 10^2$ | $2.00 \times 10^2$ | $1.20 \times 10^4$ |
| Mean | $6.00 \times 10^2$ | $2.50 \times 10^2$ | $9.00 \times 10^7$ | $1.00 \times 10^7$ |
| GR10/00209 | | | | |
| 6a | $3.60 \times 10^4$ | $1.90 \times 10^3$ | $8.70 \times 10^2$ | $8.50 \times 10^3$ |
| 6b | $7.60 \times 10^3$ | $2.20 \times 10^3$ | $1.50 \times 10^6$ | $1.30 \times 10^7$ |
| Mean | $2.18 \times 10^4$ | $2.05 \times 10^3$ | $7.50 \times 10^5$ | $6.50 \times 10^6$ |

TABLE 8-continued

| Level of Aerobic Plate Count (cfu/g) in unfiltered extracts | | | | |
|---|---|---|---|---|
| Product | Day 0 | Day 2 | Day4 | Day 7 |
| GR10/00211 | | | | |
| 7a | $3.80 \times 10^5$ | $3.00 \times 10^5$ | $2.30 \times 10^5$ | $9.90 \times 10^6$ |
| 7b | $3.00 \times 10^5$ | $2.20 \times 10^5$ | $4.40 \times 10^5$ | $2.00 \times 10^5$ |
| Mean | $3.40 \times 10^5$ | $2.60 \times 10^5$ | $3.35 \times 10^5$ | $5.05 \times 10^6$ |

TABLE 9

| Level of Yeasts (cfu/g) in unfiltered extracts | | | | |
|---|---|---|---|---|
| Product | Day 0 | Day 2 | Day4 | Day 7 |
| GR10/00199 | | | | |
| 1a | $6.50 \times 10^2$ | $1.60 \times 10^2$ | $8.60 \times 10^3$ | $2.60 \times 10^4$ |
| 1b | $3.60 \times 10^2$ | $3.90 \times 10^4$ | $5.30 \times 10^3$ | $4.40 \times 10^3$ |
| Mean | $5.05 \times 10^2$ | $1.96 \times 10^4$ | $6.95 \times 10^3$ | $1.52 \times 10^4$ |
| GR10/0201 | | | | |
| 2a | <1 | $5.60 \times 10^2$ | $1.10 \times 10^5$ | $2.00 \times 10^4$ |
| 2b | <1 | $1.20 \times 10^5$ | $1.00 \times 10^7$ | $9.40 \times 10^7$ |
| Mean | <1 | $6.03 \times 10^4$ | $5.06 \times 10^6$ | $4.70 \times 10^7$ |
| GR10/00203 | | | | |
| 3a | $4.60 \times 10^3$ | $6.90 \times 10^6$ | $2.50 \times 10^5$ | $8.40 \times 10^7$ |
| 3b | $3.60 \times 10^3$ | $6.20 \times 10^6$ | $>1.50 \times 10^7$ | $1.30 \times 10^3$ |
| Mean | $4.10 \times 10^3$ | $6.55 \times 10^6$ | $2.50 \times 10^5$ | 4.20 × 107 |
| GR10/00205 | | | | |
| 4a | <1 | $3.60 \times 10^3$ | $1.00 \times 10^5$ | $>1.50 \times 10^7$ |
| 4b | <1 | $5.70 \times 10^2$ | $2.30 \times 10^5$ | $4.90 \times 10^4$ |
| Mean | <1 | $2.09 \times 10^3$ | $1.65 \times 10^5$ | $4.90 \times 10^4$ |
| GR10/00207 | | | | |
| 5a | <1 | 12 | <1 | <1 |
| 5b | <1 | 91 | $2.20 \times 10^4$ | $9.40 \times 10^5$ |
| Mean | <1 | 51 | $2.20 \times 10^4$ | $9.40 \times 10^5$ |
| GR10/00209 | | | | |
| 6a | <1 | 2 | $4.00 \times 10^2$ | $3.30 \times 10^4$ |
| 6b | <1 | 148 | $2.00 \times 10^6$ | $1.30 \times 10^7$ |
| Mean | <1 | 75 | $1.00 \times 10^6$ | $6.52 \times 10^6$ |
| GR10/00211 | | | | |
| 7a | <1 | 58 | $7.90 \times 10^4$ | $1.00 \times 10^7$ |
| 7b | <1 | 8 | <1 | <1 |
| Mean | <1 | 33 | $7.90 \times 10^4$ | $1.00 \times 10^7$ |

TABLE 10

| Level of Moulds (cfu/g) in unfiltered extracts | | | | |
|---|---|---|---|---|
| Product | Day 0 | Day 2 | Day4 | Day 7 |
| GR10/00199 | | | | |
| 1a | 22 | 11 | 7 | 10 |
| 1b | 18 | 3 | 3 | 3 |
| Mean | 20 | 7 | 5 | 7 |
| GR10/0201 | | | | |
| 2a | <1 | 1 | 170 | $1.40 \times 10^5$ |
| 2b | <1 | 1 | 20 | <1 |
| Mean | <1 | 1 | 95 | $1.40 \times 10^5$ |
| GR10/00203 | | | | |
| 3a | 48 | 10 | 10 | 8 |
| 3b | 68 | 31 | <10 | 13 |
| Mean | 58 | 21 | 10 | 11 |

TABLE 10-continued

| Level of Moulds (cfu/g) in unfiltered extracts | | | | |
|---|---|---|---|---|
| Product | Day 0 | Day 2 | Day4 | Day 7 |
| GR10/00205 | | | | |
| 4a | 56 | 23 | 21 | 12 |
| 4b | 45 | 13 | 4 | <1 |
| Mean | 51 | 18 | 12 | 12 |
| GR10/00207 | | | | |
| 5a | 550 | 28 | 4 | 2 |
| 5b | 30 | 480 | 500 | $4.70 \times 10^2$ |
| Mean | $2.90 \times 10^2$ | $2.54 \times 10^2$ | $2.52 \times 10^2$ | $2.35 \times 10^2$ |
| GR10/00209 | | | | |
| 6a | <1 | 3 | 19 | 7 |
| 6b | <1 | 1 | <1 | <1 |
| Mean | <1 | 2 | 19 | 7 |
| GR10/00211 | | | | |
| 7a | 1 | <1 | 1 | <1 |
| 7b | <1 | 2 | 3 | 5 |
| Mean | 1 | 2 | 2 | 5 |

TABLE 11

| Level of Aerobic Plate Count (cfu/g) in filtered extracts | | | | | | | | |
|---|---|---|---|---|---|---|---|---|
| | TVC Filtered 0.2 um | | | | TVC Filtered 0.4 um | | | |
| Product | Day 0 | Day 2 | Day4 | Day 7 | Day 0 | Day 2 | Day4 | Day 7 |
| GR10/00199 | | | | | | | | |
| 1a | <1 | <1 | <1 | <1 | <1 | <1 | <1 | <1 |
| 1b | <1 | <1 | <1 | <1 | 1 | * | 8 | * |
| GR10/00201 | | | | | | | | |
| 2a | <1 | <1 | <1 | <1 | <1 | <1 | <1 | <1 |
| 2b | <1 | <1 | <1 | <1 | <1 | * | <1 | <1 |
| GR10/00203 | | | | | | | | |
| 3a | <1 | <1 | <1 | <1 | <1 | <1 | <1 | <1 |
| 3b | <1 | <1 | <1 | <1 | 1 | <1 | <1 | <1 |
| GR10/00205 | | | | | | | | |
| 4a | <1 | <1 | <1 | <1 | <1 | * | * | * |
| 4b | <1 | <1 | <1 | <1 | <1 | <1 | <1 | <1 |
| GR10/00207 | | | | | | | | |
| 5a | <1 | <1 | <1 | <1 | <1 | <1 | <1 | <1 |
| 5b | <1 | <1 | <1 | <1 | <1 | <1 | <1 | <1 |
| GR10/00209 | | | | | | | | |
| 6a | 4 | <1 | <1 | <1 | <1 | <1 | <1 | <1 |
| 6b | <1 | <1 | <1 | <1 | <1 | 1 | <1 | <1 |
| GR10/00211 | | | | | | | | |
| 7a | <1 | <1 | <1 | <1 | <1 | <1 | <1 | <1 |
| 7b | <1 | <1 | <1 | 3 | <1 | <1 | <1 | <1 |
| Sterile Water | | | | | | | | |
| 8a | <1 | <1 | <1 | <1 | <1 | 1 | <1 | <1 |
| 8b | <1 | <1 | <1 | <1 | <1 | <1 | <1 | <1 |

* contaminated sample

TABLE 12

| Level of Yeasts (cfu/g) in filtered extracts | | | | | | | | |
|---|---|---|---|---|---|---|---|---|
| | Yeasts Filtered 0.2 um | | | | Yeasts Filtered 0.4 um | | | |
| Product | Day 0 | Day 2 | Day4 | Day 7 | Day 0 | Day 2 | Day4 | Day 7 |
| GR10/00199 | | | | | | | | |
| 1a | <1 | <1 | <1 | <1 | <1 | 8 | <1 | * |
| 1b | <1 | <1 | <1 | <1 | <1 | 9 | * | <1 |
| GR10/00201 | | | | | | | | |
| 2a | <1 | <1 | 12 | <1 | <1 | 15 | <1 | <1 |
| 2b | <1 | <1 | <1 | <1 | <1 | 16 | <1 | <1 |
| GR10/00203 | | | | | | | | |
| 3a | <1 | <1 | <1 | <1 | <1 | 15 | <1 | <1 |
| 3b | <1 | <1 | <1 | <1 | <1 | 26 | <1 | <1 |
| GR10/00205 | | | | | | | | |
| 4a | <1 | <1 | <1 | <1 | <1 | 12 | <1 | <1 |
| 4b | <1 | <1 | <1 | <1 | <1 | 21 | <1 | <1 |
| GR10/00207 | | | | | | | | |
| 5a | <1 | <1 | * | * | <1 | 1 | <1 | <1 |
| 5b | <1 | <1 | 1 | <1 | <1 | <1 | <1 | <1 |
| GR10/00209 | | | | | | | | |
| 6a | <1 | <1 | <1 | <1 | <1 | 18 | <1 | <1 |
| 6b | <1 | <1 | <1 | <1 | <1 | <1 | <1 | <1 |
| GR10/00211 | | | | | | | | |
| 7a | <1 | 4 | 1 | 4 | <1 | <1 | <1 | <1 |
| 7b | <1 | 25 | <1 | 9 | <1 | 10 | <1 | <1 |
| Sterile Water | | | | | | | | |
| 8a | <1 | <1 | <1 | <1 | <1 | 37 | <1 | <1 |
| 8b | <1 | <1 | <1 | <1 | <1 | 17 | <1 | <1 |

* contaminated sample

TABLE 13

| Level of Moulds (cfu/g) in filtered extracts | | | | | | | | |
|---|---|---|---|---|---|---|---|---|
| | Moulds Filtered 0.2 um | | | | Moulds Filtered 0.4 um | | | |
| Product | Day 0 | Day 2 | Day4 | Day 7 | Day 0 | Day 2 | Day4 | Day 7 |
| GR10/00199 | | | | | | | | |
| 1a | <1 | <1 | <1 | 290 | 1 | 1 | 1 | <1 |
| 1b | <1 | <1 | <1 | <1 | <1 | <1 | 4 | <1 |
| GR10/00201 | | | | | | | | |
| 2a | <1 | <1 | <1 | 2 | <1 | <1 | 1 | <1 |
| 2b | 1 | <1 | <1 | <1 | 1 | 1 | <1 | 18 |
| GR10/00205 | | | | | | | | |
| 3a | <1 | <1 | <1 | <1 | <1 | 6 | <1 | 1 |
| 3b | 1 | <1 | <1 | 2 | <1 | 1 | 2 | <1 |
| GR10/00205 | | | | | | | | |
| 4a | <1 | <1 | <1 | 4 | <1 | 1 | 1 | 1 |
| 4b | <1 | <1 | <1 | 2 | <1 | <1 | <1 | 1 |
| GR10/00207 | | | | | | | | |
| 5a | <1 | <1 | <1 | <1 | <1 | 2 | <1 | <1 |
| 5b | <1 | <1 | <1 | <1 | <1 | <1 | 1 | <1 |
| GR10/00209 | | | | | | | | |
| 6a | <1 | <1 | <1 | <1 | 1 | 3 | <1 | <1 |
| 6b | <1 | <1 | <1 | <1 | <1 | <1 | 2 | <1 |

TABLE 13-continued

| Level of Moulds (cfu/g) in filtered extracts | | | | | | | | |
|---|---|---|---|---|---|---|---|---|
| | Moulds Filtered 0.2 um | | | | Moulds Filtered 0.4 um | | | |
| Product | Day 0 | Day 2 | Day4 | Day 7 | Day 0 | Day 2 | Day4 | Day 7 |
| GR10/00211 | | | | | | | | |
| 7a | <1 | | <1 | | <1 | <1 | <1 | <1 |
| 7b | <1 | 3 | <1 | <1 | 1 | <1 | <1 | <1 |
| Sterile Water | | | | | | | | |
| 8a | 1 | <1 | <1 | <1 | <1 | 1 | <1 | <1 |
| 8b | 1 | <1 | <1 | <1 | <1 | 2 | <1 | <1 |

The data in Tables 7 to 10 show that unfiltered extracts contained high levels of naturally present microorganisms and that these levels increased during storage. These levels would be unacceptable for administration to a human.

It is clear from the data in Tables 11 to 13 that tobacco extracts that have been filtered with a filter with a pore size of 0.2 μm or 0.45 μm have a low APC levels and low levels of yeasts and moulds, with the levels being less than 1 cfu/g in the majority of cases. This is the case not only on the day of extract preparation, but also following 7 days of storage at 25° C. Accordingly, it is clear that filtering with a filter with a pore size of 0.2 μm or 0.45 μm is an effective way of removing microorganisms.

Composition of Extract

Example 8

The alkaloid content and pH of two extracts treated according to Example 2, which were prepared in two separate batches, was analysed. The two extracts are referred to as Extract C and Extract D.

The alkaloid content (nicotine, nornicotine, anabasine, myosmine and anatabine) of the extracts was determined according to a method based on Canadian official method T-301, "Determination of Alkaloids in Whole Tobacco". The pH of the extracts was analysed according to a method based on Canadian official method T-310, "Determination of Whole Tobacco pH". Each method was carried out three times for Extracts C and D, and the results of the analyses are provided in Tables 14 and 15:

TABLE 14

| Chemical composition of Extract C: | | | | | |
|---|---|---|---|---|---|
| Tobacco Constituent | Unit | Average | SD | L. Limit (95%) | U. Limit (95%) |
| Nicotine | [ug/mL] | 20056 | 169 | 19636 | 20475 |
| Nornicotine | [ug/mL] | 219 | 30 | 144 | 295 |
| Anabasine | [ug/mL] | 68.7 | 2.3 | 63.1 | 74.4 |
| Myosmine | [ug/mL] | 8.14 | 2.46 | 2.03 | 14.2 |
| Anatabine | [ug/mL] | 294 | 7 | 278 | 311 |
| pH | [unit] | 5.41 | 0.00 | 5.41 | 5.41 |

TABLE 15

| Chemical composition of Extract D: | | | | | |
|---|---|---|---|---|---|
| Tobacco Constituent | Unit | Average | SD | L. Limit (95%) | U. Limit (95%) |
| Nicotine | [ug/mL] | 18452 | 146 | 18088 | 18815 |
| Nornicotine | [ug/mL] | 238 | 2 | 233 | 242 |
| Anabasine | [ug/mL] | 62.0 | 0.8 | 59.9 | 64.0 |

TABLE 15-continued

| Chemical composition of Extract D: | | | | | |
|---|---|---|---|---|---|
| Tobacco Constituent | Unit | Average | SD | L. Limit (95%) | U. Limit (95%) |
| Myosmine | [ug/mL] | 7.03 | 0.55 | 5.66 | 8.41 |
| Anatabine | [ug/mL] | 278 | 3 | 272 | 285 |
| pH | | 5.39 | 0.00 | 5.39 | 5.39 |

SD: Standard Deviation
L. Limit (95%): lower limit of the 95% confidence interval
U. Limit (95%): upper limit of the 95% confidence interval From the data in Tables 14 and 15, it is clear that extracts produced according to the present invention contain substantial levels of nicotine and other alkaloids. It can therefore be concluded that the tobacco extract treatment process retains nicotine and other alkaloids in the tobacco extract.

Example 9

The alkaloid content and pH of an extract treated according to Example 5 was analysed. This extract is referred to as Extract E.

The analysis of the alkaloid content and pH of Extract E was carried out as described in Example 8. Each method was carried out three times, and the results of these analyses are provided in Table 16:

TABLE 16

| Chemical composition of Extract E | | | | | |
|---|---|---|---|---|---|
| Tobacco Constituent | Unit | Average | SD | L. Limit (95%) | U. Limit (95%) |
| Nicotine | [ug/mL] | 21679 | 367 | 20767 | 22592 |
| Nornicotine | [ug/mL] | 231 | 3 | 224 | 239 |
| Anabasine | [ug/mL] | 54.7 | 0.8 | 52.7 | 56.7 |
| Myosmine | [ug/mL] | 7.60 | 0.22 | 7.05 | 8.14 |
| Anatabine | [ug/mL] | 221 | 3 | 214 | 228 |
| pH | | 5.27 | 0.00 | 5.25 | 5.28 |

SD: Standard Deviation
L. Limit (95%): lower limit of the 95% confidence interval
U. Limit (95%): upper limit of the 95% confidence interval It is clear from the data in Table 16 that Extract E, which has undergone an additional treatment process over Extracts C and D analysed in Example 8, still contains high levels of nicotine and other alkaloids in the extract.

In order to address various issues and advance the aft, the entirety of this disclosure shows by way of illustration various embodiments in which the claimed invention(s) may be practiced and provide for superior process for the production and/or treatment of a tobacco extract. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A process for the treatment of a tobacco extract, the process comprising:

producing a tobacco extract by extraction of tobacco material with a solvent consisting of water; and treating the tobacco extract by filtration, centrifugation and microfiltration to render the treated tobacco extract suitable for administration to a human, wherein the filtration is carried out prior to the centrifugation, and the centrifugation is carried out prior to the microfiltration, wherein the microfiltration removes microbes from the tobacco extract and no agents that need to be removed at a later stage are added during the process.

2. The process according to claim 1, wherein the microfiltration comprises using a membrane with a pore size of about 0.2 μm.

3. The process according to claim 1, wherein the centrifugation removes solid particles from the tobacco extract.

4. The process according to claim 1, wherein the process does not involve heating the tobacco extract to a temperature above ambient or room temperature.

5. The process according to claim 1, further comprising treating the tobacco extract by filtration with a membrane having a pore size of about 0.2 μm, prior to the microfiltration.

6. The process according to claim 1, further comprising: drying the treated tobacco extract to form a powder.

* * * * *